US009011003B2

(12) United States Patent
Pawloski

(10) Patent No.: US 9,011,003 B2
(45) Date of Patent: Apr. 21, 2015

(54) RECLOSABLE POUCH AND ZIPPER FOR A RECLOSABLE POUCH

(75) Inventor: James C. Pawloski, Bay City, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 1524 days.

(21) Appl. No.: 11/669,302

(22) Filed: Jan. 31, 2007

(65) Prior Publication Data

US 2007/0183692 A1 Aug. 9, 2007

Related U.S. Application Data

(60) Provisional application No. 60/771,590, filed on Feb. 8, 2006.

(51) Int. Cl.
*B65D 33/16* (2006.01)
*B65D 33/25* (2006.01)

(52) U.S. Cl.
CPC ..... *B65D 33/2508* (2013.01); *B65D 33/2566* (2013.01); *B65D 2205/02* (2013.01)

(58) Field of Classification Search
CPC ..... B65D 33/2533; B65D 33/2591; B65D 33/2541; B65D 33/2508; B65D 33/255; B31B 19/90; A44B 19/16; A44B 19/267
USPC ..... 383/61.2, 63, 61.3, 64
See application file for complete search history.

(56) References Cited

U.S. PATENT DOCUMENTS 503,858 A 8/1893 Katzer
1,211,025 A 1/1917 Wright
1,671,977 A 6/1928 Brown
1,724,799 A 8/1929 Jensen
2,654,527 A 10/1953 Geckler et al.
2,916,197 A 12/1959 Detrie et al.
2,978,769 A 4/1961 Harrah
3,172,443 A 3/1965 Ausnit
3,282,493 A 11/1966 Kamins et al.
3,311,144 A 3/1967 Lindley
3,338,285 A * 8/1967 Jaster et al. ..... 383/65
3,381,592 A 5/1968 Ravel (Continued)

FOREIGN PATENT DOCUMENTS

EP 0 528 721 A2 2/1993
JP 1-294448 A 11/1989

(Continued)

*Primary Examiner* — Jes F Pascua
*Assistant Examiner* — Peter Helvey

(57) ABSTRACT

A reclosable pouch includes a body portion having first and second opposing sidewalls and a first web having a first portion attached to the first sidewall and a first unattached portion. The first web is disposed on an internal side of the first sidewall. The reclosable pouch further includes a second web having a second portion attached to the second sidewall and a second unattached portion. The second web is disposed on an internal side of the second sidewall. Additionally, the reclosable pouch includes a first closure mechanism having first and second closure profiles with the first closure profile disposed on the first web at the first attached portion and the second closure profile disposed on the second web at the second attached portion. Furthermore, the reclosable pouch includes a second closure mechanism having third and fourth closure profiles with the third closure profile disposed on the first web at the first unattached portion and the fourth closure profile disposed on the second web at the second unattached portion.

8 Claims, 13 Drawing Sheets

(56) References Cited

U.S. PATENT DOCUMENTS 3,402,749 A 9/1968 Kinzler
3,509,927 A 5/1970 Hasty et al.
3,565,147 A 2/1971 Ausnit
3,567,110 A 3/1971 Susuki et al.
3,780,781 A 12/1973 Uramoto
3,877,352 A 4/1975 Brieske
3,991,801 A 11/1976 Ausnit
4,285,376 A * 8/1981 Ausnit ..... 383/203
4,375,111 A 3/1983 Hall
4,430,070 A 2/1984 Ausnit
4,528,224 A 7/1985 Ausnit
4,573,203 A 2/1986 Peppiatt
4,578,813 A 3/1986 Ausnit
4,673,383 A 6/1987 Bentsen
4,682,366 A 7/1987 Ausnit et al.
4,713,839 A 12/1987 Peppiatt
4,715,728 A 12/1987 Sfikas
4,736,450 A 4/1988 Van Erden et al.
4,756,628 A 7/1988 Branson
4,778,282 A 10/1988 Borchardt et al.
4,792,240 A 12/1988 Ausnit
4,792,983 A 12/1988 Allegre
4,807,300 A 2/1989 Ausnit et al.
4,817,188 A 3/1989 Van Erden
4,840,611 A 6/1989 Van Erden et al.
4,854,733 A 8/1989 Schwinn
4,872,766 A 10/1989 Dancy
4,877,336 A 10/1989 Peppiatt
4,878,763 A 11/1989 Ausnit
4,883,329 A 11/1989 Flannery et al.
4,912,616 A 3/1990 Van Erden
4,929,225 A 5/1990 Ausnit et al.
4,971,453 A 11/1990 Rantanen
4,985,192 A 1/1991 Roeder et al.
4,993,844 A 2/1991 Robinson et al.
5,017,021 A 5/1991 Simonsen et al.
5,033,868 A 7/1991 Peppiatt
5,070,584 A 12/1991 Dais et al.
5,102,234 A 4/1992 Levy
5,112,138 A 5/1992 Peppiatt
5,116,301 A 5/1992 Robinson et al.
5,121,995 A 6/1992 Newman et al.
5,145,258 A 9/1992 Schneck et al.
5,186,543 A 2/1993 Cochran
5,211,481 A 5/1993 Tilman
5,235,731 A 8/1993 Anzai et al.
5,238,306 A * 8/1993 Heintz et al. ..... 383/210.1
5,352,041 A 10/1994 Fullerton et al.
5,361,905 A 11/1994 McQueeny et al.
5,384,942 A 1/1995 Siegel
5,397,182 A 3/1995 Gaible et al.
5,407,277 A 4/1995 Burke et al.
5,425,456 A 6/1995 Erickson
5,470,156 A * 11/1995 May ..... 383/210
5,489,252 A * 2/1996 May ..... 383/210.1
5,577,305 A 11/1996 Johnson
5,636,783 A 6/1997 Preston
5,647,100 A 7/1997 Porchia et al.
5,660,479 A * 8/1997 May et al. ..... 383/204
5,664,303 A 9/1997 Johnson
5,672,009 A 9/1997 Malin
5,689,866 A 11/1997 Kasai et al.
5,701,996 A 12/1997 Goto et al.
5,709,478 A 1/1998 Chen
5,709,479 A 1/1998 Bell
5,709,915 A * 1/1998 Tomic et al. ..... 428/35.2
5,774,954 A 7/1998 Ramsey et al.
5,782,562 A 7/1998 Anspacher
5,788,378 A 8/1998 Thomas
5,794,315 A 8/1998 Crabtree et al.
5,851,071 A * 12/1998 Arnell ..... 383/63
5,875,611 A 3/1999 Plourde
5,882,120 A 3/1999 Bell
5,931,582 A 8/1999 Nichols
6,004,034 A 12/1999 Salam
6,010,244 A 1/2000 Dobreski et al.
6,053,635 A 4/2000 Anderson et al.
6,065,872 A * 5/2000 Johnson ..... 383/63
6,149,302 A 11/2000 Taheri
6,167,597 B1 1/2001 Malin
6,176,613 B1 1/2001 Chen
6,185,796 B1 2/2001 Ausnit
6,212,857 B1 * 4/2001 Van Erden ..... 53/412
6,220,754 B1 4/2001 Stiglic et al.
6,231,236 B1 * 5/2001 Tilman ..... 383/61.2
6,244,748 B1 6/2001 Kasai et al.
6,257,763 B1 * 7/2001 Stolmeier et al. ..... 383/5
6,270,257 B1 8/2001 Yeager
6,273,609 B1 8/2001 Johnson
6,285,140 B1 9/2001 Ruxton
6,299,351 B1 10/2001 Warr
6,345,911 B1 2/2002 Young et al.
6,361,209 B1 3/2002 LaRue et al.
6,371,644 B1 * 4/2002 Forman ..... 383/63
6,389,651 B2 * 5/2002 Johnson ..... 24/30.5 R
6,481,890 B1 11/2002 VandenHeuvel
6,533,456 B1 3/2003 Buchman
6,592,260 B1 7/2003 Randall et al.
6,595,689 B1 7/2003 Borchardt et al.
6,595,690 B2 * 7/2003 Machacek ..... 383/203
6,685,614 B1 2/2004 Arnell
6,686,005 B2 2/2004 White et al.
6,691,383 B2 2/2004 Linton
6,702,460 B1 3/2004 Geyer
6,709,157 B2 * 3/2004 VandenHeuvel et al. ..... 383/204
6,729,473 B2 5/2004 Anderson
6,755,569 B2 * 6/2004 Bois ..... 383/59
6,764,478 B2 7/2004 Ashton et al.
6,779,921 B2 8/2004 Yeager
6,789,946 B2 9/2004 Plourde et al.
6,799,890 B2 * 10/2004 Schneider et al. ..... 383/210
6,805,485 B2 10/2004 Hogan et al.
6,826,808 B2 12/2004 Kutschka
6,860,952 B2 3/2005 Pawloski
6,874,935 B2 4/2005 Edelman et al.
6,901,637 B2 6/2005 Machacek
6,910,805 B2 6/2005 Johnson
6,910,806 B2 6/2005 Strand et al.
6,913,387 B2 7/2005 Strand et al.
6,923,574 B2 8/2005 Siegel
6,925,688 B1 8/2005 Savicki
6,929,127 B1 8/2005 Delk, Sr.
6,951,420 B1 10/2005 Leighton
6,954,969 B1 10/2005 Sprehe
6,955,465 B2 10/2005 Machacek et al.
6,957,915 B2 10/2005 Tankersley
6,962,439 B2 11/2005 Taheri
6,974,256 B2 12/2005 Kinigakis et al.
6,988,828 B2 1/2006 Linneweil
7,014,363 B2 3/2006 Hanson
7,036,988 B2 * 5/2006 Olechowski ..... 383/210.1
7,090,397 B2 8/2006 Stolmeier
7,097,358 B2 8/2006 Keith et al.
7,140,772 B2 11/2006 Bois et al.
7,144,159 B2 12/2006 Piotrowski et al.
7,162,779 B2 1/2007 MacHacek
7,165,886 B2 1/2007 Linton et al.
7,189,001 B2 3/2007 Gerrits
7,192,192 B2 * 3/2007 VandenHeuvel et al. ..... 383/65
7,207,718 B2 * 4/2007 Machacek ..... 383/61.2
7,254,873 B2 * 8/2007 Stolmeier et al. ..... 24/400
7,255,477 B2 * 8/2007 Arnell ..... 383/64
7,574,781 B2 * 8/2009 Ackerman et al. ..... 24/399
7,574,782 B2 * 8/2009 Ackerman ..... 24/400
7,674,040 B2 * 3/2010 Dowd et al. ..... 383/61.2
7,748,904 B2 * 7/2010 Henn et al. ..... 383/38
7,784,160 B2 * 8/2010 Dais et al. ..... 24/585.12
7,886,412 B2 * 2/2011 Dais et al. ..... 24/585.12
8,066,434 B2 * 11/2011 Nanba et al. ..... 383/204
2003/0002753 A1 * 1/2003 Stolmeier et al. ..... 383/64
2003/0169948 A1 * 9/2003 Fenzl et al. ..... 383/61.2
2004/0045138 A1 * 3/2004 Kasai ..... 24/399
2004/0091186 A1 5/2004 Shibata
2004/0120613 A1 6/2004 Hanson

(56) References Cited

U.S. PATENT DOCUMENTS

| | | | | |
|---|---|---|---|---|
| 2004/0146223 | A1 | 7/2004 | Marquet et al. | |
| 2004/0161178 | A1 | 8/2004 | Olechowski | |
| 2004/0234171 | A1 | 11/2004 | Dais et al. | |
| 2004/0234172 | A1* | 11/2004 | Pawloski | 383/61.2 |
| 2005/0041894 | A1 | 2/2005 | Hanson | |
| 2005/0069227 | A1 | 3/2005 | Steele | |
| 2005/0135712 | A1 | 6/2005 | Barbier et al. | |
| 2005/0152623 | A1 | 7/2005 | Marley et al. | |
| 2005/0185863 | A1 | 8/2005 | Carrillo | |
| 2005/0229365 | A1 | 10/2005 | Offa-Jones | |
| 2005/0235468 | A1 | 10/2005 | Borchardt et al. | |
| 2005/0244083 | A1* | 11/2005 | McMahon et al. | 383/63 |
| 2005/0254731 | A1 | 11/2005 | Berbert et al. | |
| 2005/0259894 | A1 | 11/2005 | Swartz et al. | |
| 2005/0259895 | A1 | 11/2005 | Kozak | |
| 2005/0271307 | A1 | 12/2005 | Pawloski et al. | |
| 2005/0271308 | A1 | 12/2005 | Pawloski | |
| 2005/0276524 | A1 | 12/2005 | Taheri | |
| 2005/0282695 | A1 | 12/2005 | Yeager | |
| 2005/0286810 | A1 | 12/2005 | Sprague et al. | |
| 2005/0286811 | A1 | 12/2005 | Sprague et al. | |
| 2005/0286812 | A1 | 12/2005 | Sprague et al. | |
| 2005/0286817 | A1 | 12/2005 | Hall et al. | |
| 2006/0013513 | A1 | 1/2006 | Meyer | |
| 2006/0029299 | A1* | 2/2006 | Share et al. | 383/63 |
| 2006/0034551 | A1 | 2/2006 | Linneweil | |
| 2006/0045390 | A1 | 3/2006 | Sill et al. | |
| 2006/0093242 | A1* | 5/2006 | Anzini et al. | 383/63 |
| 2006/0111226 | A1* | 5/2006 | Anzini et al. | 493/214 |
| 2006/0182369 | A1 | 8/2006 | Schneider et al. | |
| 2006/0210202 | A1* | 9/2006 | Plourde | 383/63 |
| 2006/0282996 | A1* | 12/2006 | Ackerman et al. | 24/399 |
| 2008/0159662 | A1* | 7/2008 | Dowd et al. | 383/63 |
| 2008/0232722 | A1* | 9/2008 | Pawloski et al. | 383/64 |
| 2011/0097018 | A1* | 4/2011 | Turvey et al. | 383/63 |

FOREIGN PATENT DOCUMENTS

| | | | |
|---|---|---|---|
| JP | 1-308754 | A | 12/1989 |
| JP | 4-317602 | A | 11/1992 |
| JP | 06-092363 | A | 4/1994 |
| JP | 9-77096 | A | 3/1997 |
| JP | 3094269 | A | 8/2000 |

* cited by examiner

RECLOSABLE POUCH AND ZIPPER FOR A RECLOSABLE POUCH

CROSS REFERENCE TO RELATED APPLICATIONS

This application claims the benefit of U.S. Provisional Patent Application No. 60/771,590, filed Feb. 8, 2006, and entitled "Large Reclosable Pouch with Two Closure Mechanisms."

REFERENCE REGARDING FEDERALLY SPONSORED RESEARCH OR DEVELOPMENT

Not applicable

SEQUENTIAL LISTING

Not applicable

BACKGROUND

1. Field of the Invention

The present invention relates to reclosable pouches, and more particularly, to reclosable pouches having closures that include two closure mechanisms.

2. Description of the Background

Reclosable pouches that have two closure mechanisms, each including opposing interlocking closure elements, are known. In one instance, a closure for a reclosable thermoplastic pouch includes first and second profile strips. One profile strip has two elongate male interlocking profiles extending from one side of a backing member. The other profile strip has two elongate female interlocking profiles extending from one side of another backing member. The entire backing member of each profile strip is laminated to a respective first or second pouch wall.

In another instance, a similar set of profile strips also includes a center post extending from the backing member between the male interlocking profiles and a bumper ridge disposed on opposite ends of each backing member. The bumper ridges and the center post allow the profile strips to be sealed to thermoplastic film across the widths of their respective backing members without crushing or distorting the interlocking members.

SUMMARY OF THE INVENTION

According to one embodiment of the present invention, a reclosable pouch includes a body portion having first and second opposing sidewalls and a first web having a first portion attached to the first sidewall and a first unattached portion. The first web is disposed on an internal side of the first sidewall. The reclosable pouch further includes a second web having a second portion attached to the second sidewall and a second unattached portion. The second web is disposed on an internal side of the second sidewall. Additionally, the reclosable pouch includes a first closure mechanism having first and second closure profiles with the first closure profile disposed on the first web at the first attached portion and the second closure profile disposed on the second web at the second attached portion. Furthermore, the reclosable pouch includes a second closure mechanism having third and fourth closure profiles with the third closure profile disposed on the first web at the first unattached portion and the fourth closure profile disposed on the second web at the second unattached portion.

According to another embodiment of the present invention, a zipper for a reclosable bag includes first and second closure profiles disposed between first and second internal walls. The first and second internal walls are attached to first and second opposing sidewalls, respectively, of a reclosable bag. The first closure profile is attached to the first and second internal walls opposite adjacent a point where the first and second internal walls are attached to the first and second sidewalls, respectively. The second closure profile is attached to portions of the first and second internal walls that are not attached to the first and second sidewalls.

According to yet another embodiment, a reclosable pouch includes a body portion having a sidewall and an opening into an interior. The reclosable pouch further includes a flange disposed on an internal side of the first sidewall. The flange has an attached portion secured to the sidewall and at least one unattached portion not secured to the sidewall. Furthermore, the reclosable pouch includes a first closure mechanism for resealably closing the opening. The first closure mechanism includes a first profile disposed on the flange. Additionally, the reclosable pouch includes a second closure mechanism for resealably closing the opening. The second closure mechanism includes a second profile disposed on the flange. At least one of the first and second profiles is disposed on an unattached portion of the flange.

Other aspects and advantages will become apparent upon consideration of the following detailed description, in which the same reference numbers indicate the same structures in the various embodiments.

DETAILED DESCRIPTION

Figure 1:
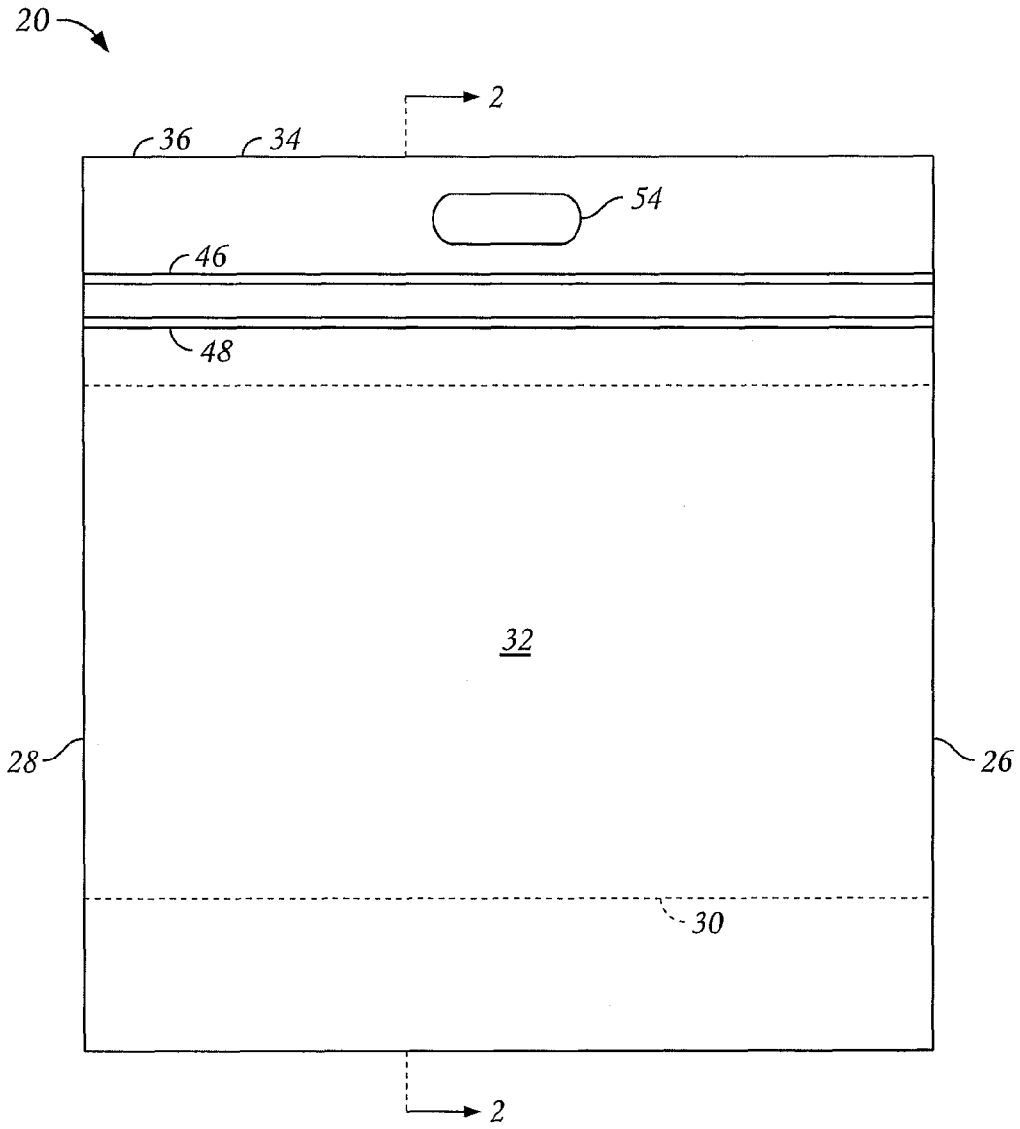
FIG. 1 is a side elevational view of a reclosable thermoplastic storage bag.
Figure 2:
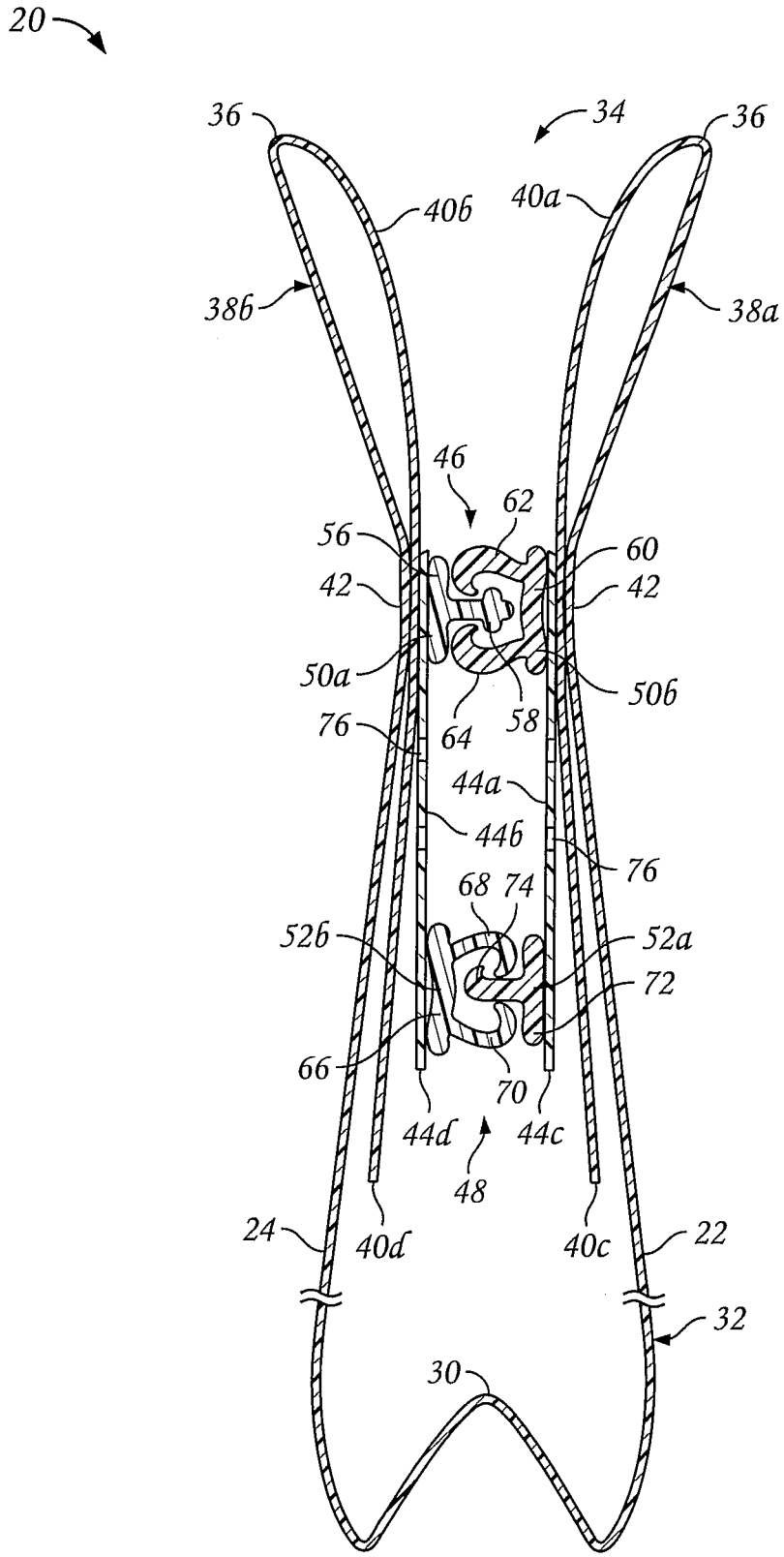
FIG. 2 is a cross-sectional view taken generally along the line 2-2 of FIG. 1 depicting a closure mechanism according to a first embodiment with portions behind the plane of the cross-section omitted for clarity.
Figure 3:
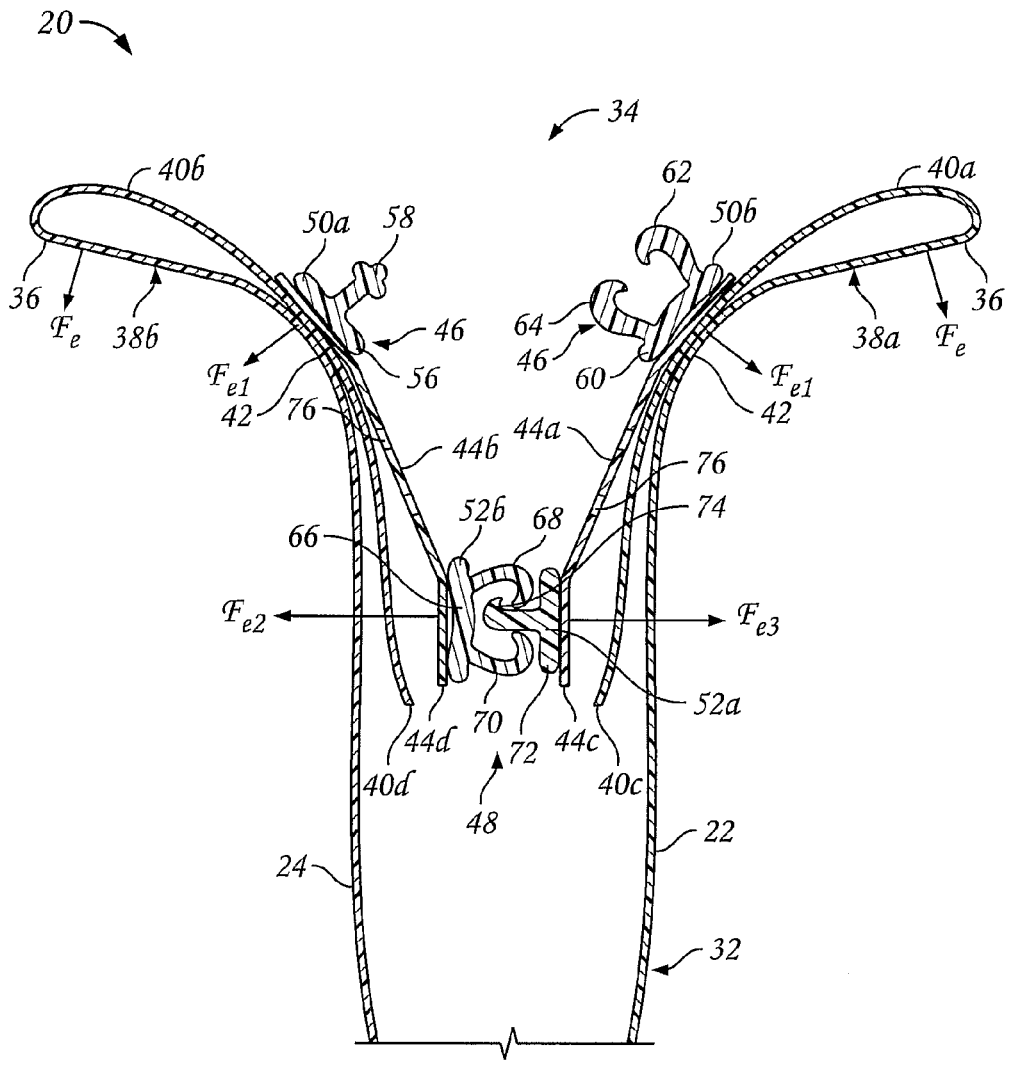
FIG. 3 is a partial cross-sectional view similar to FIG. 2 depicting an opening operation of the closure mechanism of FIG. 2.

Referring to FIGS. 1-3, a reclosable pouch in the form of a thermoplastic storage bag 20 has opposing bag walls 22, 24 joined at side portions 26, 28 and at a gusset 30 disposed along a bottom portion of the storage bag to form a body portion 32. An opening 34 into an interior of the bag 20 is disposed along a top edge 36 of each of the bag walls 22, 24. A top end of each of the bag walls 22, 24 is folded down inwardly at the respective top edges 36 to form two opposing lips 38*a*, 38*b*, respectively. The lips 38*a*, 38*b* have opposing internal webs 40*a*, 40*b*, respectively, extending downwardly from the top edges 36. Each of the internal webs 40*a*, 40*b* is laminated to the respective bag wall 22, 24 at only a single area, such as a lamination strip 42, between respective interior or bottom ends 40*c*, 40*d* of the internal webs and the top edges 36. Flanges 44*a* and 44*b* are also laminated to the internal webs 40*a*, 40*b*, respectively, at or substantially coextensive with the lamination strip 42. Resealably interlockable closure mechanisms 46, 48 are disposed between the flanges 44*a* and 44*b* with the closure mechanism 46 disposed between the closure mechanism 48 and the top edge 36. The closure mechanism 46 includes male and female closure elements or portions 50*a*, 50*b*, which are disposed on opposing internal surfaces of the flanges 44*a*, 44*b*. The male closure element 50*a* is laminated to an inside surface of the flange 44*b* substantially coextensive with the lamination strip 42, and the female closure element 50*b* is laminated to an inside surface of the flange 44*a* substantially coextensive with the lamination strip 42. The closure mechanism 48 includes male and female closure elements or portions 52*a* and 52*b*, respectively, which are disposed on opposing internal surfaces of the flanges 44*a*, 44*b* near respective bottom ends 44*c*, 44*d* thereof. The bottom ends 44*c*, 44*d* of the flanges 44*a*, 44*b* behind the closure mechanism 48 in this embodiment are not attached to the bottom ends 40*c*, 40*d* of the internal webs 40*a*, 40*b* or to the bag walls 22, 24. Similarly, the internal webs 40*a*, 40*b* are not attached to the bag walls 22, 24, respectively, between the respective top edges 36 and the lamination strip 42. In one embodiment, the closure mechanism 46 is parallel to the closure mechanism 48 and spaced therefrom a distance that is sufficiently small to create the perception to a user that both mechanisms act as a single closure. These results may be achieved by spacing the closure mechanisms 46 and 48 a distance of, for example, between about 0.2 inch (5.08 mm) and about 0.3 inch (7.62 mm) apart, or between about 0.22 inch (5.59 mm) and about 0.28 inches (7.11 mm) apart, or about 0.25 inch (6.35 mm) apart. A handle 54 is disposed in the lips 38*a*, 38*b* and opposing internal webs 40*a*, 40*b* above the closure mechanisms 46, 48. In one embodiment, the handle 54 is formed by an oblong hole through the internal webs 40*a*, 40*b* and the lips 38*a*, 38*b*. In another embodiment, the handle 54 includes one or more rigid members secured to the lips 38*a*, 38*b* and/or other known handle devices.

The closure elements 50*a*, 50*b*, 52*a*, and 52*b* in some embodiments have a cross sectional shape and/or are formed in accordance with the teachings of Geiger et al., U.S. Pat. No. 4,755,248. The closure elements 50*a*, 50*b*, 52*a*, and 52*b* in other embodiments have a cross sectional shape and/or are formed in accordance with the teachings of Zieke et al., U.S. Pat. No. 4,741,789. In yet other embodiments, the closure elements 50*a*, 50*b*, 52*a*, and 52*b* have a cross sectional shape and/or are formed in accordance with the teachings of Porchia et al., U.S. Pat. No. 5,012,561. Each of these patents is owned by the assignee of the present application and is hereby incorporated by reference herein in the entirety thereof. In one embodiment, the first closure mechanism 46 exhibits a first closure characteristic and the second closure mechanism 48 exhibits a second closure characteristic different than the first closure characteristic. For example, either or both of the first and second closure mechanisms 46, 48 may exhibit a relatively low level of resistance to bag opening forces but provide a high level of deformation so as to exhibit a clicking feel and/or sound when the bag is opened or closed. In addition, either or both of the first and second closure mechanisms 46, 48 may exhibit a low level of deformation but provide a relatively high overall resistance to bag opening forces. Further, either or both of the male closure elements 50*a*, 52*a* may be symmetric or asymmetric about a longitudinal centerline thereof, and either or both of the female closure elements 50*b*, 52*b* may be symmetric or asymmetric about a longitudinal centerline thereof.

In the embodiment shown in FIGS. 2 and 3, each of the male and female elements 50*a*, 50*b* is symmetric about a longitudinal centerline thereof. The male closure element 50*a* includes a base member 56 disposed on an internal surface of the flange 44*b* with an arrow-shaped engagement member 58 extending therefrom. The female closure element 50*b* has a C-shaped profile, which includes a base member 60 disposed on an internal surface of the flange 44*a* with spaced-apart inwardly hooked legs 62, 64 extending therefrom. The female closure element 50*b* is adapted to interlockingly receive the male element 50*a* when urged together by a closing pressure, such as by a user's finger during closing of the pouch. Similarly, the female closure element 52*b* has a C-shaped profile, which includes a base member 66 disposed on an internal surface of the flange 44*b* with spaced-apart inwardly hooked legs 68, 70 extending therefrom. The male closure element 52*a* includes a base portion 72 disposed on an internal surface of the flange 44*a* with an upwardly turned asymmetrical hooked engagement member 74 extending therefrom. (As used throughout, relative positional descriptors, such as up, down, left, right, etc., are with respect to the figures, it being understood that different orientation would change such relative positions.)

In one embodiment, the engagement member 58 of the male closure element 50*a* may have ridges on opposite sides thereof equally spaced from a distal end as shown. In other embodiments, the male closure element 50*a* may have points or hooks protruding from sides thereof. Other types of profiles of the engagement member 50*a* should be apparent to those skilled in the art.

As illustrated in FIG. 3, in one embodiment, a high external opening force $F_e$ of about 4-6 lbs/inch (0.79-1.18 kg/cm) is required to open the bag 20. The external opening force $F_e$ reduces the propensity of the bag 20 to open due to stress exerted on the closure mechanisms 46, 48 by weight of contents (not shown) placed inside the bag when the bag is held by a user from the handle 54 shown in FIG. 1. In another embodiment, a relatively large bag with an internal holding capacity of approximately 72 lbs. (33 kg) has an opening of approximately 24 inches (61 cm) long that is secured or closed by the closure mechanisms 46, 48. In this embodiment, the closure mechanisms 46, 48 have an external opening force of approximately 3 lbs/inch (0.54 kg/cm). The male closure element 50*a* disengages from the female closure element 50*b* with a first external opening force $F_{e1}$, and the male closure element 52*a* disengages from the female closure element 52*b* with a second external opening force $F_{e2}$. The first and second external opening forces $F_{e1}$ and $F_{e2}$ are exerted from a side of the bag 20 nearer the top edge 36, such as from the handle 54, as opposed to internal bursting forces, which act on the closure mechanisms 46, 48 from the contents stored within the bag 20. Internal bursting forces, however, have a similar opening effect as the external opening force described above because the bag walls 22, 24 are only secured to the closure mechanism 46 at the lamination strip 42 and not to the unattached bottom ends 44*c*, 44*d* where the closure mechanism 48 is attached. The first external opening force $F_{e1}$ is larger than the second external opening force $F_{e2}$ because of the asymmetrical hooked engagement member 74 on the male closure element 52*a*. Once the first external opening force $F_{e1}$ causes the closure mechanism 46 to open, the first external opening force $F_{e1}$ is translated by momentum into the second external opening force $F_{e2}$ that opens the closure mechanism 48. The asymmetrical hooked engagement member 74 of the male element 52*a* may help to reduce the closing force required for closure mechanism 48 because the female closure element 52*b* does not have to stretch around an extra hook portion on the opposite side of the engagement member 74 of the male closure element 52*a*. This reduced stretching may allow the closure mechanism 48 to be closed with less force than is required to close the closure mechanism 46. In the event that the closure mechanism 48 pops open inadvertently while the pouch is in use due to internal bursting forces, the closure mechanism 46 remains closed until the opening force thereof is met. In such an instance, the closure mechanism 46 is less likely to open inadvertently if the bag 20 is being held by the handle 54, such as by a user's hand, because of opposing forces exerted on the closure mechanism keeping portions of the top edges 36 together.

In one embodiment, a venting mechanism is incorporated into the bag 20 in the form of one or more holes through one or both of the flanges disposed between the upper closure mechanism and the lower closure mechanism. In bag 20, for example, a plurality of holes 76 extends through each of the flanges 44*a*, 44*b*. The holes 76 are disposed between the closure mechanism 46 and the closure mechanism 48. In one method of venting excess air from the bag 20, the closure mechanism 48 is closed first. Then, excess air is expelled from the bag 20 through the holes 76. After expelling the excess air, the closure mechanism 46 is closed to complete a seal along the top edge 36. In the case where holes 76 are utilized for venting, the closure mechanisms 46 and 48 may be spaced a distance of, for example, between about 0.3 inch (7.62 mm) and about 0.4 inch (10.16 mm) apart, or between about 0.32 inch (8.13 mm) and about 0.38 inches (9.65 mm) apart, or about 0.35 inch (8.89 mm) apart.

Figure 4:
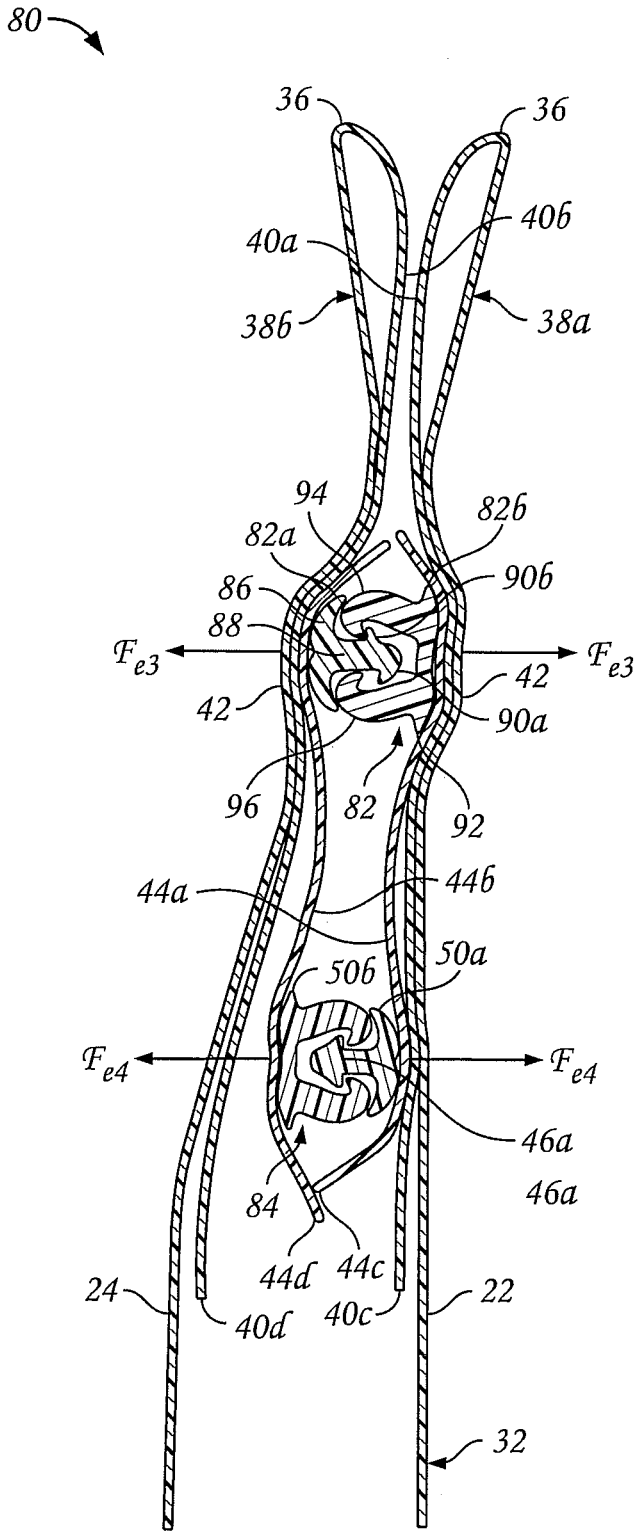
FIG. 4 is a partial cross-sectional view taken generally along the line 2-2 of FIG. 1 similar to FIG. 2 depicting a closure mechanism according to another embodiment.

In another embodiment depicted in FIG. 4, a bag 80 (which is generally similar to the bag 20) has an upper closure mechanism 82 and a lower closure mechanism 84. The lower closure mechanism 84 is disposed on a product side of the bag 80. The upper closure mechanism 82 is disposed on an opening side of the bag 80 between the top edge 36 and the lower closure mechanism 84. The upper closure mechanism 82 includes a male closure element 82*a* disposed on the inner surface of the flange 44*b* interlockingly opposing a female closure element 82*b* disposed on the inner surface of the flange 44*a*. External surfaces of the flanges 44*a*, 44*b* are attached, such as by lamination or adhesive, to the internal webs 40*a*, 40*b*, respectively, at the single area or lamination strip 42, opposite the upper closure mechanism 82. The upper male closure element 82*a* includes a base member 86 disposed on the flange 44*b* and an asymmetric hooked engagement member 88 extending therefrom. The asymmetric hooked engagement member 88 has a downwardly turned hook 90*a* and an upper protrusion, such as a ridge or upwardly turned hook 90*b*. In one embodiment, the upwardly turned hook 90*b* is smaller and disposed lower on the stem than the downwardly turned hook 90*a*, which lowers the force needed to occlude the male and female closure elements 82*a*, 82*b* because the female closure element does not pass over the upwardly turned hook 90*b* and the downwardly turned hook 90*a* at the same time. In another embodiment, the upwardly turned hook 90*b* may be the same size or larger than the downwardly turned hook 90*a* depending on the opening and closing properties desired. The female closure element 82*b* has a C-shaped profile and includes a base member 92 disposed on flange 44*a*, with spaced-apart inwardly hooked legs 94, 96 extending therefrom. The female closure element 82*b* is adapted to interlockably receive the male closure element 82*a* when a closing pressure urges the closure elements together, such as by a user's finger during closing of the bag 80. In this embodiment, the lower closure mechanism 84 is substantially similar to the upper closure mechanism 46 shown in FIGS. 2 and 3. The lower closure mechanism 84 includes a male closure element 50*a* disposed on the inner surface of the flange 44*a* interlockingly opposing a female closure element 50*b* disposed on the inner surface of the flange 44*b*. The lower closure mechanism 84 is disposed between the upper closure mechanism 82 and the bottom ends 44*c*, 44*d* of the flanges 44*a*, 44*b*, respectively.

The asymmetric hooked engagement member 88 reduces the closing force required to close the upper closure mechanism 82 while requiring a larger opening force. The larger downwardly turned hook 90*a* of the engagement member 88 has a higher external opening force than the opposing smaller upwardly turned hook 90*b*. In one embodiment, the upper closure mechanism 82 provides a smooth sensation and the lower closure mechanism 84 provides a clicking sensation during a closing operation. Illustratively, an external opening force $F_{e3}$ of about 4-6 lbs./inch (0.79-1.18 kg/cm) is required to open upper closure mechanism 82, and the lower closure mechanism 84 has a lower external opening force $F_{e4}$ of about 3-5 lbs./inch (0.59-0.98 kg/cm) because of the symmetrical arrow-shaped engagement member 46*a*. Vent holes (not shown) similar to the holes 76 may be included as part of a similar venting mechanism as heretofore described with respect to FIGS. 2 and 3. In another embodiment (not shown), areas of the respective flanges 44*a*, 44*b* and internal webs 40*a*, 40*b* generally coextensive with one of the closure elements 50*a* or 50*b* may also a laminated with the respective bag wall 22 or 24 leaving only one of the closure elements 50*a*, 50*b*, 82*a*, or 82*b* unsecured directly to one of the bag walls through the flanges and internal webs.

Figure 5:
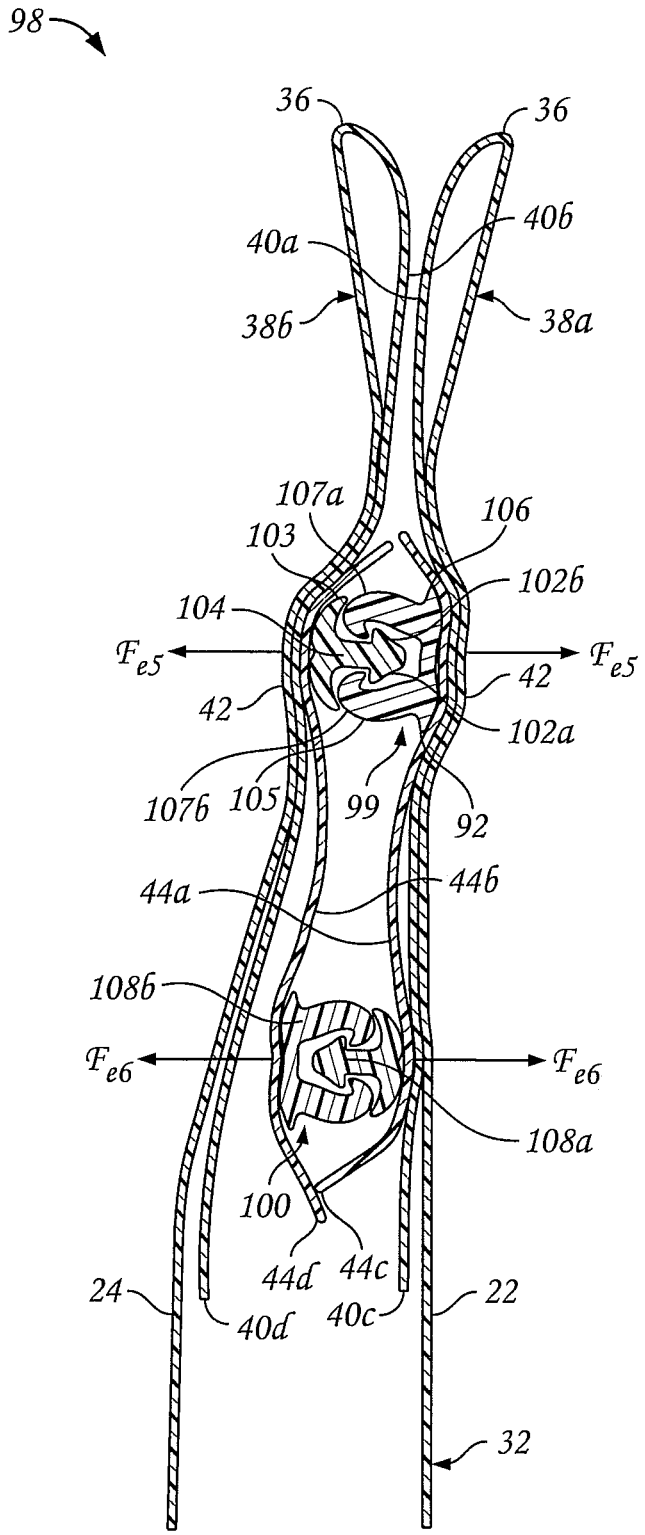
FIG. 5 is a partial cross-sectional view taken generally along the line 2-2 of FIG. 1 similar to FIG. 2 depicting a closure mechanism according to a further embodiment.

Referring to FIG. 5, another embodiment of a reclosable bag 98 similar to the bags 20 and 80 is depicted. The reclosable bag 98 includes an upper closure mechanism 99 and a lower closure mechanism 100. The lower closure mechanism 100 is disposed on a product side of the bag 98 and the upper closure mechanism 99 is disposed on an opening side of the bag 98 between the top edge and the lower closure mechanism 100. The upper closure mechanism 99 includes a male closure element 102*a* disposed on the inner surface of the flange 44*b* interlockingly opposing a female closure element 102*b* disposed on the inner surface of the flange 44*a*. External surface of the flanges 44*a*, 44*b* are attached, such as by lamination or adhesive to the internal webs 40*a*, 40*b*, respectively, at the single are or lamination strip 42, opposite the upper closure mechanism 99. The upper male closure element 102*a* includes a base member 103 disposed on the flange 44*b* and a symmetrical hooked engagement member 104 extending therefrom. The female closure element 102*b* has a C-shaped profile 105 and includes a base member 106 disposed on the flange 44*a*, with spaced-apart inwardly hooked legs 107*a*, 107*b* extending therefrom. The female closure element 102*b* is adapted to interlockably receive the male closure element 102*a* when a closing pressure urges the closure elements 102*a*, 102*b* together, such as by a user's finger during closing of the bag 98. In this embodiment, the lower closure mechanism 100 is substantially similar to the upper closure mechanism 99. The lower closure mechanism 100 includes a male closure element 108*a* disposed on the inner surface of the flange 44*a* interlockingly opposing a female closure element 108*b* disposed on the inner surface of the flange 44*b*. The lower closure mechanism 100 is disposed between the upper closure mechanism 99 and the bottom ends 44*c*, 44*d* of the flanges 44*a*, 44*b*.

As with other embodiments, the top ends of the bag walls 22, 24 of FIG. 5 are folded down inwardly at respective top edges 36 to form two opposing lips 38*a*, 38*b*, respectively. The internal webs 40*a*, 40*b* of the lips 38*a*, 38*b* extend downwardly behind the flanges 44*a*, 44*b* such that when the flanges 44*a*, 44*b* are laminated to the bag walls 22, 24, respectively, the internal webs 40*a*, 40*b* are also laminated to the bag walls 22, 24 as a lamination strip 42. In the embodiment of FIG. 5, the lamination strip 42 is disposed only behind the male and female closure elements 102*a*, 102*b* of the upper closure mechanism 99.

In one embodiment, the upper closure mechanism 99 of FIG. 5 provides a smooth sensation and the lower closure mechanism 100 provides a clicking sensation during a closing operation. Vent holes (not shown) similar to the holes 76 may optionally be included as part of a similar venting mechanism as heretofore described with respect to FIGS. 2 and 3.

Figure 6:
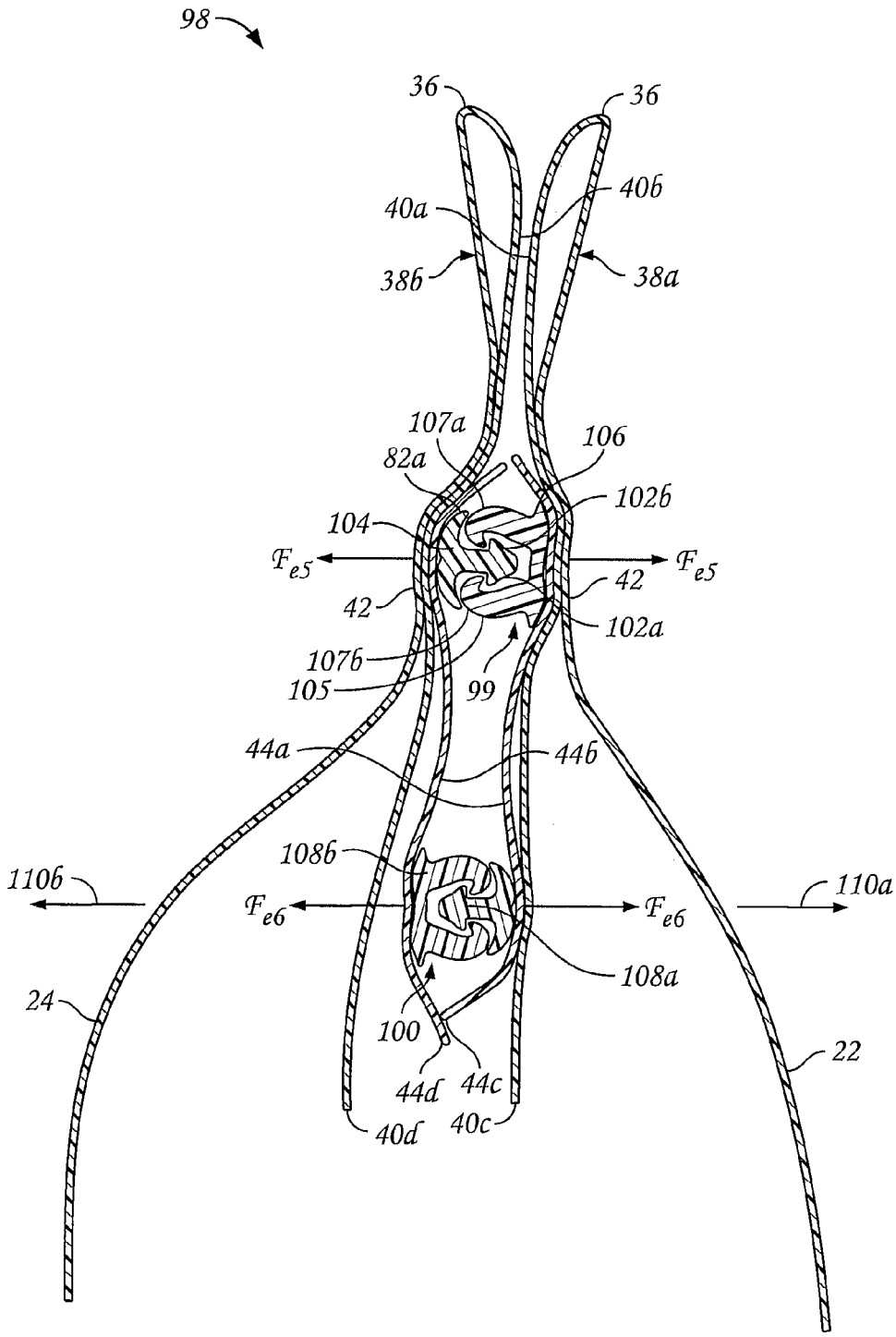
FIG. 6 is a partial cross-sectional view of the closure mechanism of FIG. 5 depicting operation of the closure mechanism and bag when pressure is exerted from within the bag.

FIG. 6 depicts a method of operation of the bag 98 of FIG. 5 when pressure is exerted from inside the bag 98, it being understood that the method of operation of the bags 20 and 80 of FIGS. 2-4 is similar. As pressure is exerted from within the bag 98, the bag walls 22, 24 move outwardly as indicated by arrows 110*a*, 110*b*. Since the flanges 44*a*, 44*b* are only attached to the bag walls 22, 24 at the lamination points 42 behind the closure elements 102*a*, 102*b*, no direct pressure is exerted on the closure elements 108*a*, 108*b* of the lower closure mechanism 100. Such a design prevents the lower closure mechanism 100 from inadvertently opening due to pressure from within the bag 98. In the embodiment of FIGS. 5 and 6, an external opening force $F_{e5}$ of about 4-6 lbs./inch (0.79-1.18 kg/cm) is required to open the upper closure mechanism 99 and the lower closure mechanism 100 has a lower external opening force $F_{e6}$ of about 3-6 lbs./inch (0.59-1.18 kg/cm).

Figure 7:
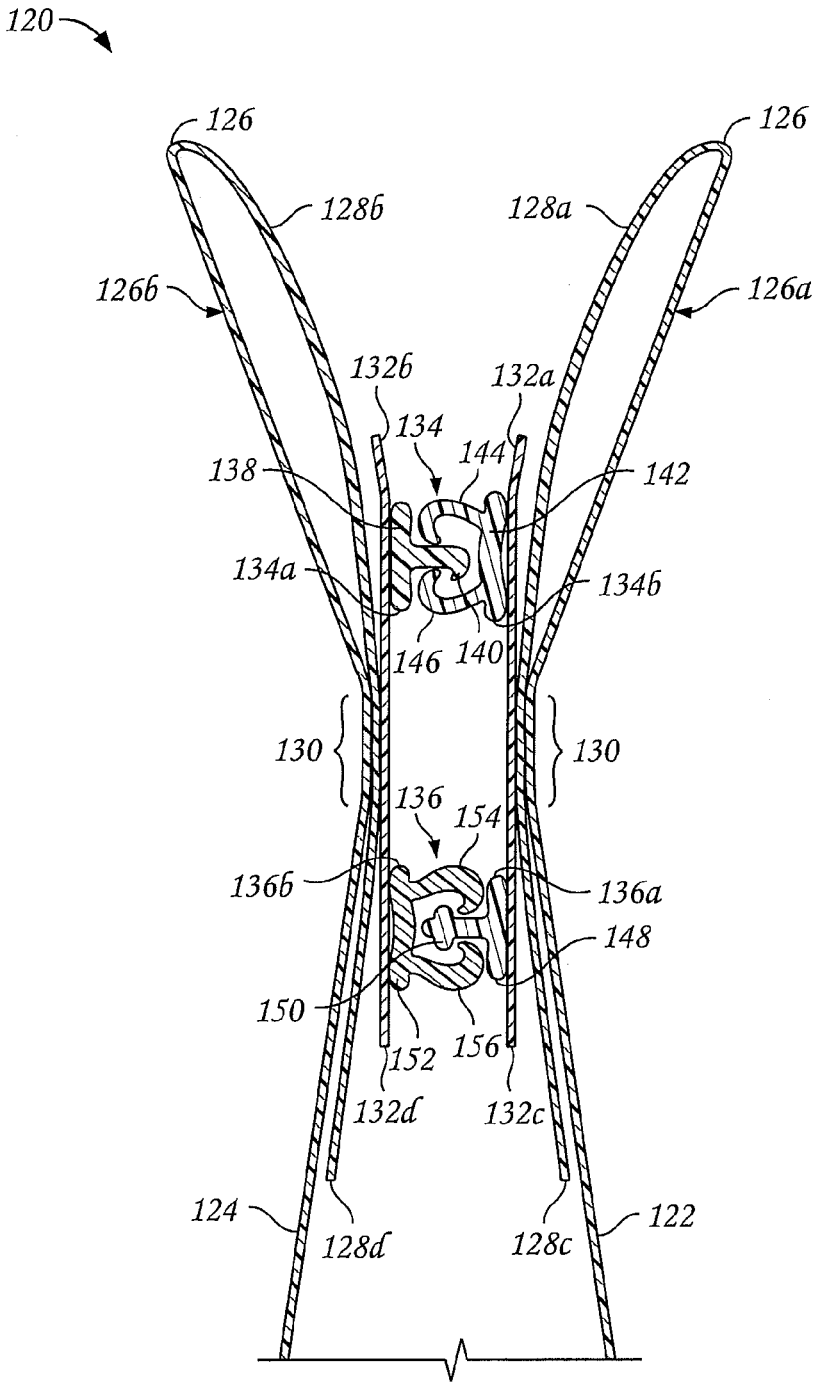
FIG. 7 is a partial cross-sectional view taken generally along the line 2-2 of FIG. 1 similar to FIG. 2 depicting a closure mechanism according to yet another embodiment.
Figure 8:
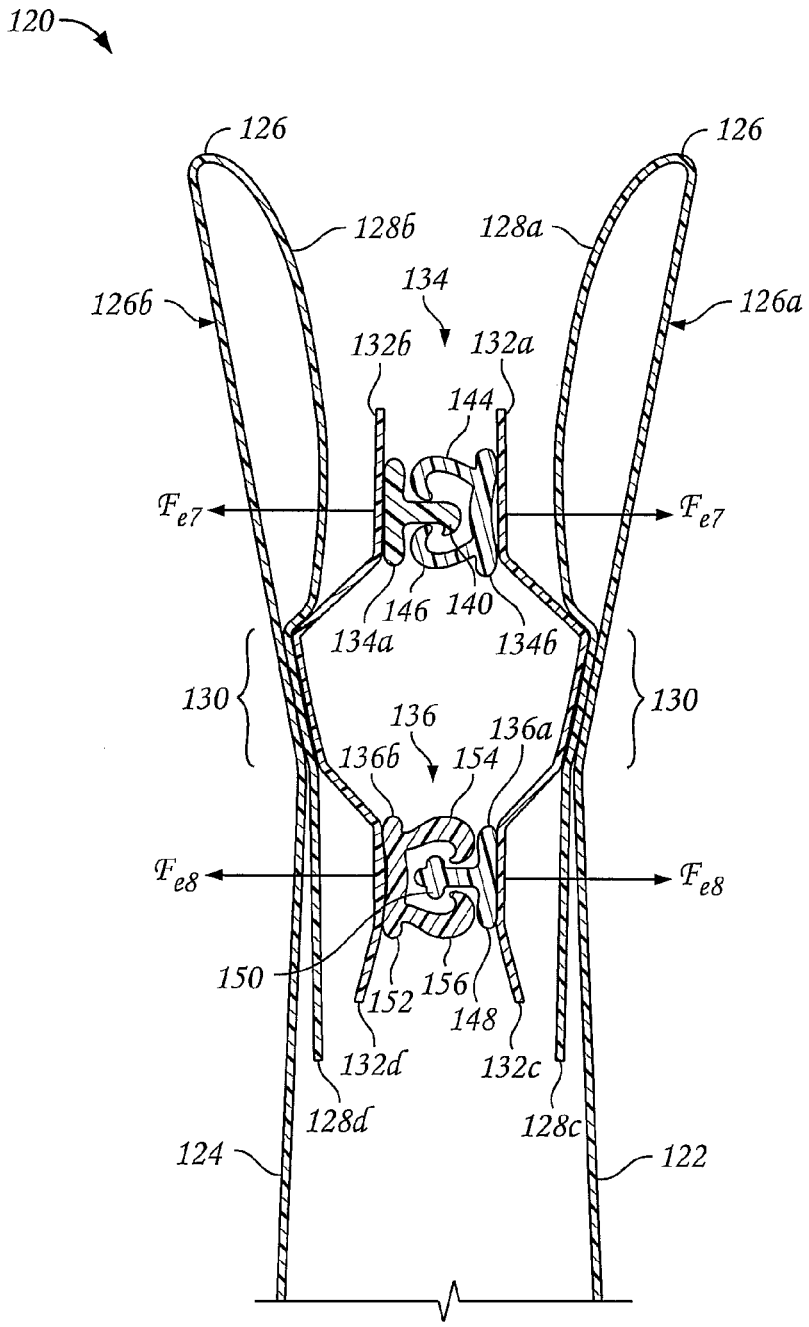
FIG. 8 is a partial cross-sectional view similar to FIG. 7 depicting the effect of an opening force on the closure mechanism of FIG. 7.

In yet another embodiment shown in FIGS. 7 and 8, a reclosable bag 120 (which is similar to the bags 20 and 80) includes opposing bag walls 122, 124. Top ends of the bag walls 122, 124 are folded downwardly and inwardly at a top edge 126 to form two opposing lips 126*a*, 126*b*. The lips 126*a*, 126*b* include opposing internal webs 128*a*, 128*b*, respectively, that extend downwardly from the top edge 126. The internal webs 128*a*, 128*b* are attached to the bag walls 122, 124, respectively, at a single area, such as by lamination at a lamination strip 130, between bottom edges 128*c* and 128*d* of the internal webs 128*a*, 128*b* and the top edges 126. Flanges 132*a*, 132*b* are attached to internal webs 128*a*, 128*b* at or coextensive with the lamination strip 130. Resealable closure mechanisms 134, 136 are disposed between the flanges 132*a*, 132*b* on opposite sides of the lamination strip 130. The flanges 132*a*, 132*b* are not attached to the internal webs 128*a*, 128*b*, respectively, behind the closure mechanisms 134, 136, thereby leaving upper and lower ends of the flanges unattached to the internal webs. Similarly, the lower ends 132*c*, 132*d* of the flanges 132*a*, 132*b* are not attached to the bag walls 122, 124. The closure mechanism 134 includes a male closure element 134*a* disposed on an internal surface of flange 132*b* interlockingly opposing a female closure element 134*b* disposed on an internal surface of the flange 132*a*. The male closure element 134*a* includes a base member 138 disposed on the flange 132*b* and an asymmetric downwardly hooked engagement member 140 extending therefrom. The female closure element 134*b* has a C-shaped profile and includes a base member 142 disposed on the flange 132*a* with spaced-apart inwardly hooked legs 144, 146 extending therefrom. The female closure element 134*b* is adapted to interlockably receive the male closure element 134*a* when a closing pressure urges the closure elements together. The closure mechanism 136 includes a male closure element 136*a* disposed on the internal surface of the flange 132*a* interlockingly opposing a female closure element 136*b* disposed on the internal surface of flange 132*b*. Each of the male closure element 136*a* and the female closure element 136*b* is symmetric about a centerline thereof. The male closure element 136*a* includes a base member 148 disposed on an internal surface of the flange 132*a* with a symmetrical arrow-shaped engagement member 150 extending therefrom. The female closure element 136*b* has a C-shaped profile, which includes a base member 152 disposed on an internal surface of the flange 132*b* with spaced-apart inwardly hooked legs 154, 156 extending therefrom.

The closure mechanism 134 is parallel to the closure mechanism 136 and spaced therefrom a distance that is sufficiently small to create the perception to a user that both mechanisms act as a single closure. In some embodiments, the closure mechanisms 134, 136 are spaced sufficiently far apart such that a user's fingers and/or thumb are guided therebetween during a closing operation. These results may be achieved, for example, by spacing the closure mechanisms 134, 136 between about 0.1 inch (2.54 mm) and about 0.3 inch (7.62 mm) apart, or between about 0.15 inch (3.81 mm) and about 0.25 inch (6.35 mm) apart, or about 0.20 inch (5.08 mm) apart. Different distances between the closure elements 134, 136 may be used depending on the desired application thereof.

As illustrated in FIG. 8, a first external opening force $F_{e7}$ applied to the bag 120 at top portions 126*a*, 126*b* causes the closure mechanism 134 to open. A second external opening force $F_{e8}$ is required to open the closure mechanism 136. In the present embodiment, however, the closure mechanism 136 can be designed to require about the same external opening force as the closure mechanism 134. Therefore, the first external opening force $F_{e7}$ required to open the closure mechanism 134 can be easily translated to open the closure mechanism 136. Additionally, the symmetric arrow-shaped engagement member 150 of the closure mechanism 136 provides a clicking effect during closing, which is caused by the closing force required to stretch the inwardly hooked legs 154, 156 over the symmetric arrow-shaped engagement member 150 during a closing operation. In another embodiment (not shown), coextensive or non-coextensive holes through the bag walls 122, 124, interior webs 128*a*, 138*b*, and the flanges 132*a*, 132*b* can be disposed between the closure mechanisms 134, 136 to provide one or more vent paths (not shown) for exhausting air out of the bag 120. For example, the air may be exhausted by first closing the closure mechanism 134, then squeezing the air out of the bag 120 through the vent paths, and then closing the closure mechanism 136.

Figure 9:
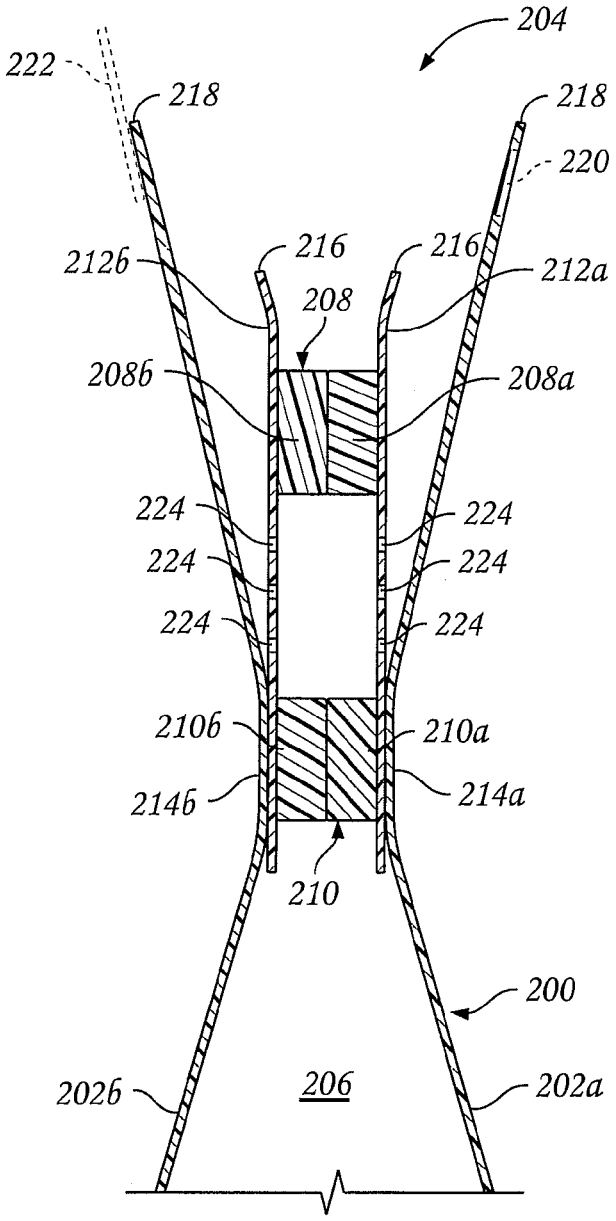
FIGS. 9 and 10 are diagrammatic partial cross-sectional views similar to FIG. 2 of closure mechanisms according to even further embodiments of the present invention.
Figure 10:
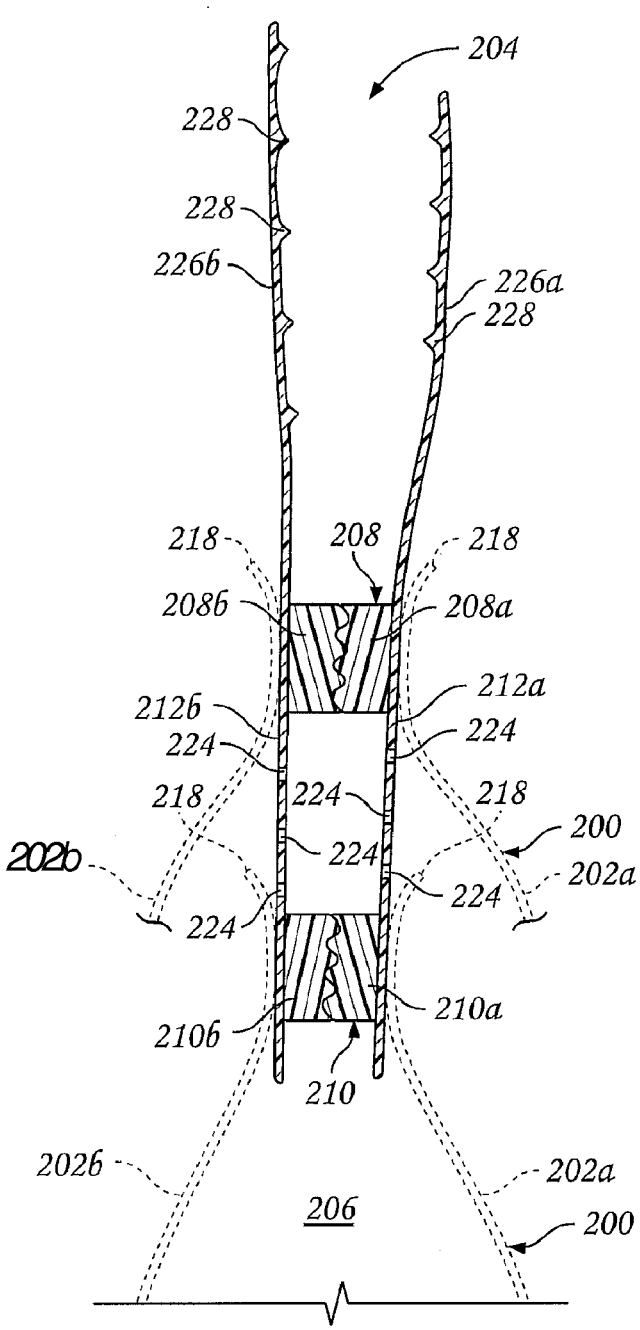

In FIGS. 9 and 10, another bag 200, including opposing sidewalls 202*a*, 202*b* defining a mouth 204 into an interior 206, has a double closure mechanism tape and a venting system. In the embodiment shown in FIG. 9, the double closure mechanism tape includes an outer closure mechanism 208 spaced from an inner closure mechanism 210, both of which are carried between opposing backing tapes 212*a*, 212*b*. Each closure mechanism 208, 210 includes opposing closure members 208*a*, 208*b* and 210*a*, 210*b*, respectively, which may take the specific form of any known closure mechanism, such as any of the closure mechanisms disclosed previously herein or other known zipper profiles and closure mechanisms. Each backing tape 212*a*, 212*b* is attached, such as by lamination, to the respective bag wall 202*a*, 202*b* only at one location 214*a*, 214*b*, respectively, which is coextensive with or opposite the inner closure mechanism 210, leaving outer ends 216 of the backing tape carrying the outer closure mechanism 208 unattached to the bag walls. In this embodiment, top ends 218 of the bag sidewalls 202*a*, 202*b* are not folded over. Rather, the top ends 218 of the sidewalls 202*a* and 202*b* are single ply walls that extend beyond the outer ends 216 of the backing tapes 212*a*, 212*b*, and a handle is formed with the top ends of the bag sidewalls 202*a*, 202*b*, such as with a finger hole 220 or a rigid handle attachment 222. The bag 200 includes a venting mechanism, such as holes 224 through each backing tape 212*a*, 212*b* between the outer closure mechanisms 208 and the inner closure mechanism 210. To expel excess air from the bag, the outer closure mechanism 208 is first closed, excess air is then expelled through the holes 224, and then the inner closure mechanism 210 is closed to form a seal.

In the embodiment shown in FIG. 10, each backing tape 212*a*, 212*b* includes a lip 226*a* and 226*b*, respectively, which extends beyond the top ends 218 of the bag sidewalls 202*a*, 202*b*. Traction members, such as bumps, recesses, and/or elongate grip ridges 228, are disposed on an inside surface of the lips 226*a*, 226*b* to facilitate gripping traction when opening the double closure mechanism tape. As shown in FIG. 10, the sidewalls 202*a*, 202*b*, may be attached to an outside surface of the respective backing tapes 212*a*, 212*b* opposite either the inner closure members 210*a*, 210*b* or the outer closure members 208*a*, 208*b*. In another embodiment, the sidewalls 202*a*, 202*b* are attached to the outside surface of the respective backing tapes 212*a*, 212*b* between the inner closure mechanism 210 and the outer closure mechanism 208 similar to the embodiment shown in FIGS. 7 and 8. In a further embodiment, the traction members are omitted so that the inside surfaces of the lips 226*a*, 226*b* are smooth, and handles, such as the finger hole 220 or the rigid handle attachment 222, are disposed on one or both of the lips 226*a*, 226*b* in a similar manner as shown in FIG. 9 on the sidewalls 202*a*, 202*b*.

Figure 11:
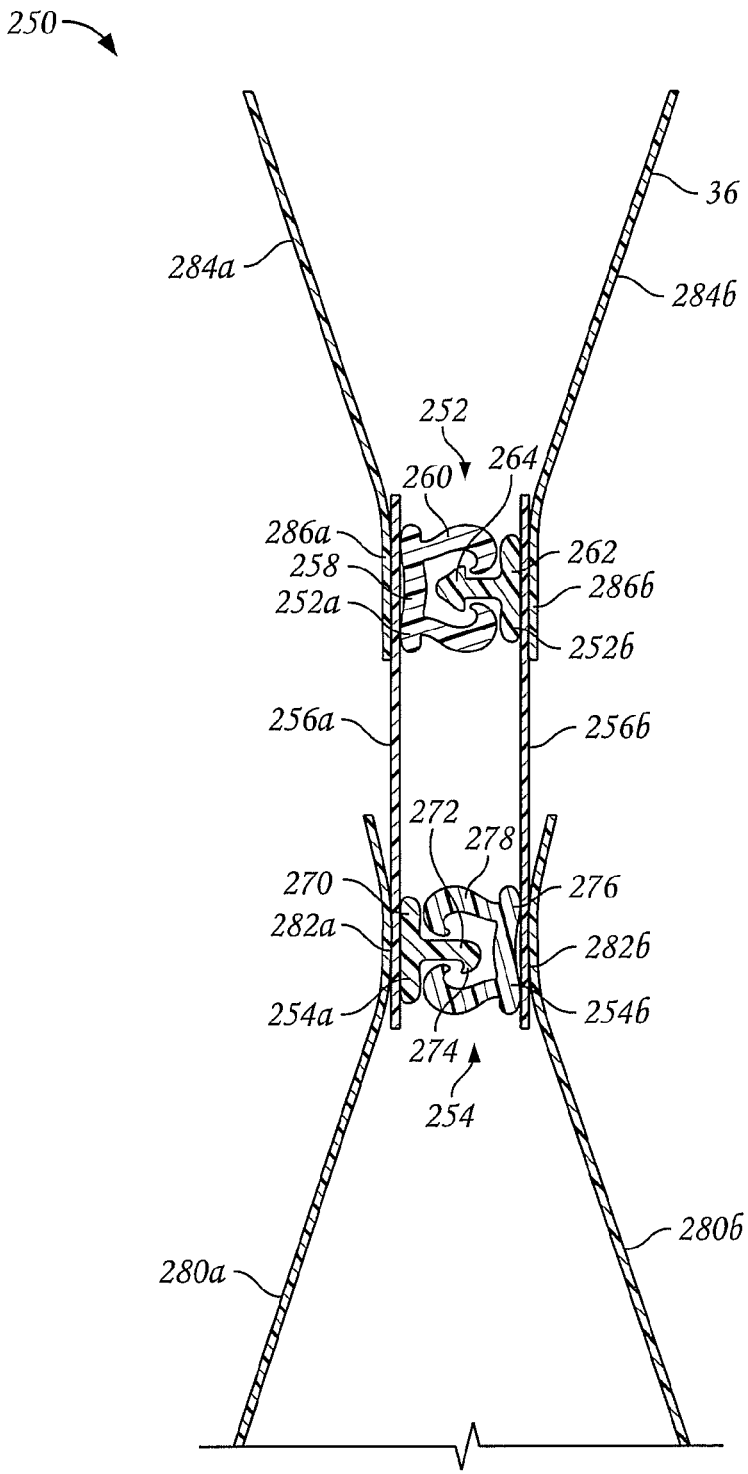
FIGS. 11-13 are partial cross-sectional views taken generally along the lines 2-2 of FIG. 1 similar to FIG. 2 depicting closure mechanisms according to further embodiments.

In another embodiment depicted in FIG. 11, a bag 250 (which is generally similar to the bag 20) has an upper closure mechanism 252 and a lower closure mechanism 254. The lower closure mechanism 254 is disposed on a product slide of the bag 250 and the upper closure mechanism 252 is disposed on an opening side of the bag 250 between the top edge 36 and the lower closure mechanism 254. The upper closure mechanism 252 includes a female closure element 252*a* disposed on an inner surface of a first flange 256*a* interlockingly opposing a male closure element 252*b* disposed on an inner surface of a second flange 256*b*. The upper female closure element 252*a* includes a base member 258 and a symmetrical C-shaped profile 260 extending from the inner surface of the first flange 256 toward the male closure element 252*b*. The upper male closure element 252*b* is adapted to engage the upper female closure element 252*a*, wherein the male closure element 252*b* includes a base member 262 disposed on the flange 256*b* and a symmetrical arrow-shaped profile 264 extending from the inner surface of the flange 256*b* toward the female closure element 252*a*.

The lower closure mechanism 254 includes a male closure element 254*a* disposed on the inner surface of the first flange 256*a* interlockingly opposing a female closure element 254*b* disposed on the inner surface of the second flange 256*b*. The lower male closure element 254*a* includes a base member 270 disposed on the flange 256*a* and an asymmetric hooked engagement member 272 extending therefrom. The asymmetric hooked engagement member has a downwardly turned hook 274 that requires a higher opening force from within the bag 250 to disengage the closure elements 254*a*, 254*b* and requires a lower external opening force to disengage the closure elements 254*a*, 254*b*. In fact, when the upper closure elements 252*a*, 252*b* are disengaged, the lower closure elements 254*a*, 254*b* fall open due to the absence of a hook opposite the hooked engagement member 272. The female closure element 254*b* includes a base member 276 and a C-shaped profile 278 extending therefrom, wherein the female closure element 254*b* is adapted to engage the hooked engagement member 272.

Still referring to the embodiment of FIG. 11, external surfaces of the flanges 256*a*, 256*b* are attached, such as by lamination or adhesive, to bag walls 280*a*, 280*b* at first attachment areas 282*a*, 282*b*. The first attachment areas 282*a*, 282*b* are disposed opposite the closure elements 254*a*, 254*b*. In addition, external surfaces of the flanges 256*a*, 256*b* are attached in a similar manner to first and second handle portions 284*a*, 284*b* at second attachment areas 286*a*, 286*b*. The second attachment areas 286*a*, 286*b* are disposed opposite the closure elements 252*a*, 252*b*, respectively. The handle portions 286*a*, 286*b* may have a thickness that is greater than a thickness of the bag walls 280*a*, 280*b*. For example, the handle portions 284*a*, 284*b* may have a thickness of 6 mils (0.15 mm) and the bag walls 280*a*, 280*b* may have a thickness of 2.5 mils (0.064 mm). In addition, the handle portions 284*a*, 284*b* may be comprised of a different material or materials than the bag walls 280*a*, 280*b*.

Figure 12:
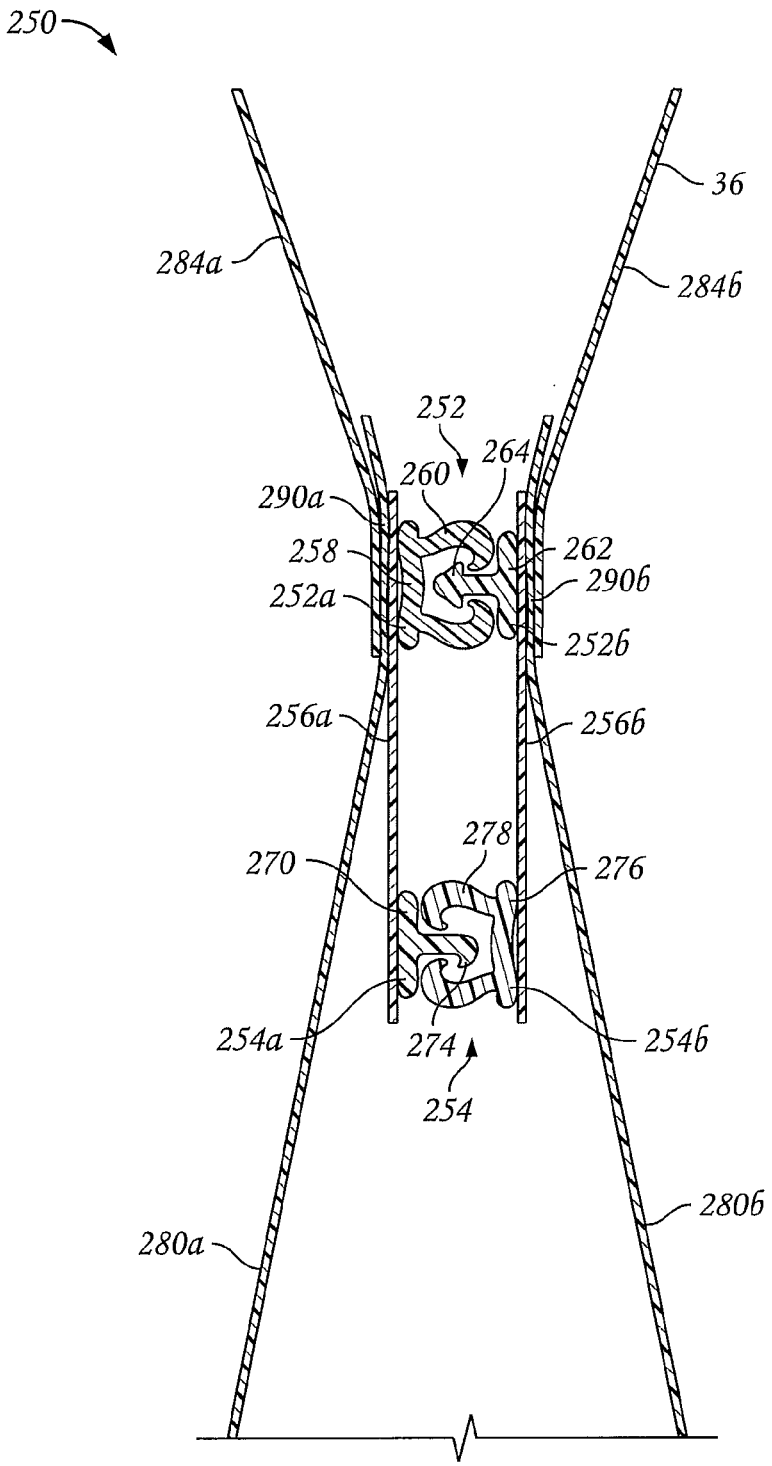

FIG. 12 depicts an embodiment of the bag 250 of FIG. 11, wherein the closure mechanisms 252, 254 are identical, but the method of attachment of the flanges 256*a*, 256*b* to the bag walls 280*a*, 280*b* and the handle portions 284*a*, 284*b* is different. In particular, external surfaces of the flanges 256*a*, 256*b* are attached in a manner similar to that of FIG. 11, to both the bag walls 280*a*, 280*b* and handle portions 284*a*, 284*b* at attachment areas 290*a*, 290*b*, respectively. The attachment areas 290*a*, 290*b* are disposed opposite the closure elements 252*a*, 252*b* to increase the opening force needed to open the lower closure mechanism 254 from the product side of the bag 250, as discussed in detail above. Although the bag walls 280*a*, 280*b* are depicted as being disposed adjacent the flanges 256*a*, 256*b*, the handle portions 284*a*, 284*b* may alternatively be disposed adjacent the flanges 256*a*, 256*b*. The bag walls 280*a*, 280*b* and handle portions 284*a*, 284*b* may have thicknesses similar to those of FIG. 11. As with the embodiment of FIG. 11, the bag walls 280*a*, 280*b* and the handle portions 284*a*, 284*b* may be made of different materials.

Figure 13:
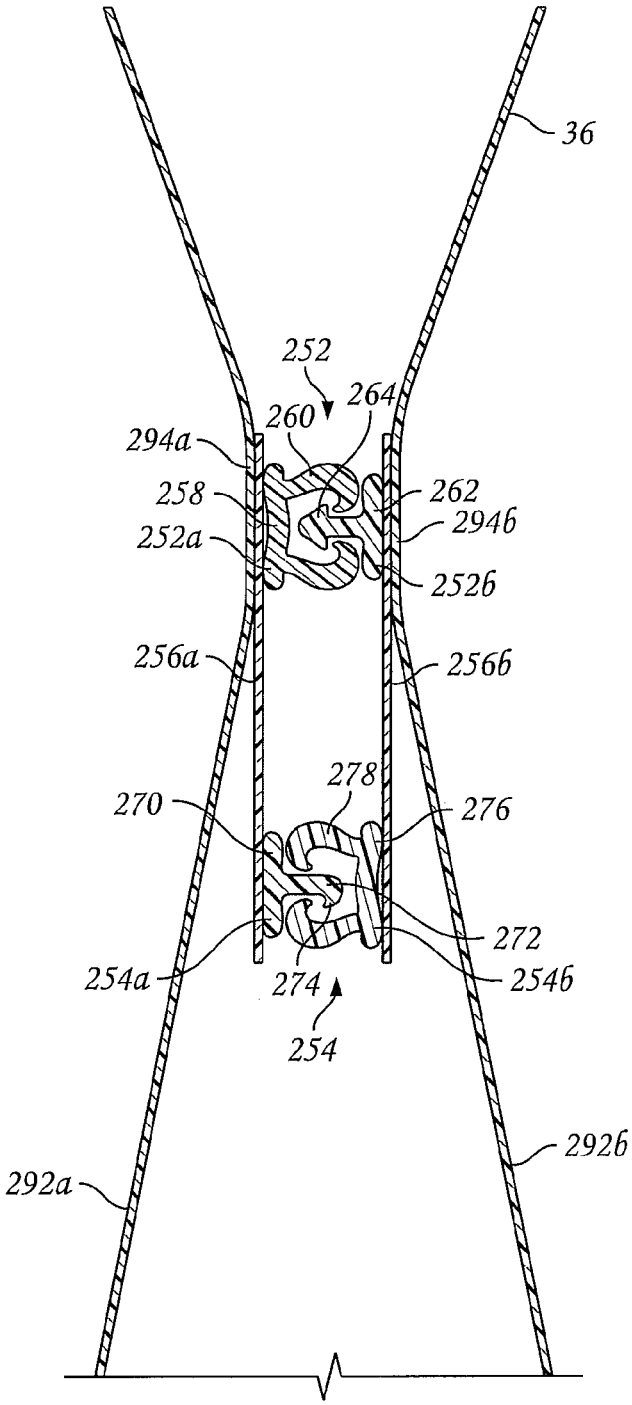

Another embodiment of the bag 250 of FIG. 11 with identical closure mechanisms 252, 254, but a different method of attachment is depicted in FIG. 13. First and second bag walls 292*a*, 292*b* are attached in a manner similar to that described above to the flanges 256*a*, 256*b* at attachment areas 294*a*, 294*b*, respectively. The attachment areas 294*a*, 294*b* are disposed opposite the closure elements 252*a*, 252*b* to increase the opening force needed to open the lower closure mechanism 254 from the product side of the bag 250, as discussed in detail above. The bag walls 292*a*, 292*b* extend below the flanges 256*a*, 256*b* to form the bag 250 and extend above the flanges 256*a*, 256*b* to form handles 296*a*, 296*b*.

Although two closure mechanisms are depicted in each of the embodiments herein, any number of closure mechanisms may be used.

It will be apparent to those skilled in the art that numerous combinations of symmetric and asymmetric male and female closure elements are possible to create pouches of various sizes and shapes with a multitude of differing opening and closing forces. The number of closure mechanisms and the order and placement on the pouch walls may be varied to adjust the opening and closing characteristics of the pouch. Additionally, it is envisioned that various other closure characteristics, such as tactile feedback, aural feedback, etc., can be used in conjunction with the aforementioned embodiments.

INDUSTRIAL APPLICABILITY

The pouch described herein provides a plurality of different closure characteristics and can provide greater security against inadvertent opening of the pouch. The distance between the closure mechanisms can be varied as desired and the male and female closure elements may be disposed on either bag wall. A bag including a dual closure mechanism with at least one of the closure mechanisms disposed along a portion of a backing flange that is not attached to the bag walls may reduce inadvertent opening of the closure mechanisms due to internal bursting forces in a larger bag. Further, a pouch having a double zipper tape with at least one zipper not being laminated or directly secured to the pouch walls allows the zipper tape to be attached to film for forming the pouch walls using conventional hot bar, single-zipper sealing technology with only minimal change to existing production sealing equipment to accommodate the added width of the double zipper tape.

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out same. The exclusive rights to all modifications that come within the scope of the disclosure are reserved.

I claim:

1. A reclosable pouch comprising:

a first sidewall;

a second sidewall connected to the first sidewall so as to form an interior of the pouch with an opening adjacent to a top edge of the pouch;

a first web connected to the first sidewall at the top edge of the pouch, the first web extending downwardly from the top edge of the pouch and ending at a first bottom end, the first web being positioned between the first and second sidewalls, and the first web comprising an attached portion that is attached to the first sidewall at a position below the top edge of the pouch and above the first bottom end, the first bottom end being unattached to the first sidewall;

a second web connected to the second sidewall at the top edge of the pouch, the second web extending downwardly from the top edge of the pouch and ending at a second bottom end, the second web being positioned between the first and second sidewalls, and the second web comprising an attached portion that is attached to the second sidewall at a position below the top edge of the pouch and above the second bottom end, the second bottom end being unattached to the second sidewall;

a first flange positioned between the first and second webs and between the first and second sidewalls, the first flange comprising a first portion and a second portion, with the first portion being attached to the first web at the attached portion of the first web, and the second portion being positioned adjacent to and unattached to the first bottom end;

a second flange positioned between the first and second webs and between the first and second sidewalls, the second flange comprising a first portion and a second portion, with the first portion being attached to the second web at the attached portion of the second web, and the second portion being positioned adjacent to and unattached to the second bottom end;

a first closure profile and a second closure profile extending from the first flange below the top edge of the pouch, the first closure profile being attached to the first flange at the first portion of the first flange and the second closure profile being attached to the first flange at the second portion of the first flange; and a third closure profile and a fourth closure profile extending from the second flange below the top edge of the pouch, the third closure profile being attached to the second flange at the first portion of the second flange and configured to interlock with the first closure profile, and the fourth closure profile being attached to the second flange at the second portion of the second flange and configured to interlock with the second closure profile.

2. The reclosable pouch of claim 1, wherein the first closure profile extending from the first flange is attached to a region of the first portion of the first flange that is not attached to the first web.

3. The reclosable pouch of claim 2, wherein the third closure profile extending from the second flange is attached to a region of the first portion of the second flange that is not attached to the second web.

4. The reclosable pouch of claim 1, wherein one of the first and second closure profiles extending from the first flange is a male member, and one of the third and fourth closure profiles extending from the second flange is a female member, and wherein the other one of the first and second closure profiles extending from the first flange is a female member, and the other one of the third and fourth closure profiles extending from the second flange is a male member.

5. The reclosable pouch of claim 1, wherein the first sidewall and the first web are connected at a fold at the top edge of the pouch, and the second sidewall and the second web are connected at a fold at the top edge of the pouch.

6. A reclosable pouch comprising:

a first sidewall;

a second sidewall connected to the first sidewall so as to form an interior of the pouch with an opening adjacent to a top edge of the pouch;

a first web connected to the first sidewall at the top edge of the pouch, the first web having an attached portion that is attached to the first sidewall and an unattached portion that is not attached to the first sidewall, and the first web (i) extending downwardly from the top edge of the pouch and ending at a first bottom end, and (ii) being positioned between the first and second sidewalls;

a second web connected to the second sidewall at the top edge of the pouch, the second web having an attached portion that is attached to the second sidewall and an unattached portion that is not attached to the second sidewall, and the second web (i) extending downwardly from the top edge of the pouch and ending at a second bottom end, and (ii) being positioned between the first and second sidewalls;

a first flange being positioned between the first and second webs and between the first and second sidewalls, the first flange comprising a first portion and a second portion, with the first portion being attached to the first web at the attached portion of the first web, and the second portion being positioned adjacent to and unattached to the unattached portion of the first web;

a second flange being positioned between the first and second webs and between the first and second sidewalls, the second flange comprising a first portion and a second portion, with the first portion being attached to the second web at the attached portion of the second web, and the second portion being positioned adjacent to and unattached to the unattached portion of the second web;

a first closure profile and a second closure profile extending from the first flange below the top edge of the pouch, the first closure profile being attached to the first flange at a position that is adjacent to the first portion of the first flange that is attached to the attached portion of the first web, and the second closure profile being attached to the first flange at a position that is adjacent to the second portion of the first flange that is not attached to the first web; and a third closure profile and a fourth closure profile extending from the second flange below the top edge of the pouch, the third closure profile being attached to the second flange at a position that is adjacent to the first portion of the second flange that is attached to the attached portion of the second web, the fourth closure profile being attached to the second flange at a position that is adjacent to the second portion of the second flange that is not attached to the second web, the third closure profile being configured to interlock with the first closure profile, and the fourth closure profile being configured to interlock with the second closure profile.

7. The reclosable pouch of claim 6, wherein one of the first and second closure profiles extending from the first flange is a male member, and one of the third and fourth closure profiles extending from the second flange is a female member, and wherein the other one of the first and second closure profiles extending from the first flange is a female member, and the other one of the third and fourth closure profiles extending from the second flange is a male member.

8. The reclosable pouch of claim 6, wherein the first sidewall and the first web are connected at a fold at the top edge of the pouch, and the second sidewall and the second web are connected at a fold at the top edge of the pouch.

* * * * *